US007703168B2

(12) United States Patent
Bennett

(10) Patent No.: US 7,703,168 B2
(45) Date of Patent: Apr. 27, 2010

(54) BUMPER AND DUSTING ATTACHMENT FOR VACUUM CLEANER HEAD

(76) Inventor: Lynne M. Bennett, 13003 E. 33rd Ct., Spokane Valley, WA (US) 99206

( * ) Notice: Subject to any disclaimer, the term of this patent is extended or adjusted under 35 U.S.C. 154(b) by 863 days.

(21) Appl. No.: 11/580,496

(22) Filed: Oct. 16, 2006

(65) Prior Publication Data

US 2008/0086832 A1 Apr. 17, 2008

(51) Int. Cl.
*A47L 9/00* (2006.01)

(52) U.S. Cl. ..... 15/246.2; 15/325

(58) Field of Classification Search ..... 15/325, 15/97.1, 98, 208, 209.1, 223, 246.2, 247; *A47L 9/00*
See application file for complete search history.

(56) References Cited

U.S. PATENT DOCUMENTS 4,797,968 A * 1/1989 Wenzlick et al. ..... 15/246
4,831,682 A * 5/1989 White ..... 15/246.2
4,876,762 A * 10/1989 Foster ..... 15/246.2

* cited by examiner

*Primary Examiner*—David A Redding
(74) *Attorney, Agent, or Firm*—Bergman & Jeckle PLLC

(57) ABSTRACT

A bumper and dusting attachment for a vacuum cleaner head generally provides a flexible body of mesh material having fleece on its exterior surface. The body defines a medial chamber and has a first end portion, a second end portion, a top edge, a bottom edge, a back surface and a front. Padding, having a retentive memory, fills the medial chamber adding thickness to the body. A protruding lip formed in the front surface extends elongately from the first end portion to the second end portion and protrudes outwardly from the front surface when the body is fastened to a vacuum cleaner head. Cooperating strips of hook and loop fastener carried by the back surface of the body and on the vacuum cleaner head provide for releasable attachment of the body to the vacuum cleaner head.

8 Claims, 2 Drawing Sheets

BUMPER AND DUSTING ATTACHMENT FOR VACUUM CLEANER HEAD

RELATED APPLICATIONS

There are no applications related hereto heretofore filed in this or in any foreign country.

BACKGROUND OF THE INVENTION

1. Field of the Invention

This invention relates to brushes, scrubbers and general cleaning, and more particularly to a protective bumper cleaning attachment for vacuum cleaner heads.

2. Background and Description of Prior Art

Most carpeted interior spaces have mop-boards, or similar moldings, attached to vertical walls adjacent the floor. Mop boards protect the wall adjacent the floor from damage, commonly caused by vacuum cleaners, as well as provide some decoration and contrast between the floor and wall. Unfortunately, because mop boards extend somewhat horizontally from the wall, they tend to collect dust and dirt, and therefore need to be cleaned on a regular basis. Dusting of mop boards generally requires a person to crawl on their hands and knees around the periphery of the room with a cleaning apparatus, or to use a long handled brush type cleaning apparatus. In either case, cleaning the mop boards is a separate task performed independently of other cleaning tasks.

The instant invention eliminates the separate task of cleaning mop boards by providing a resiliently deformable cleaning body of heavy pile fleece on an exterior surface that is releasably fastened to a periphery of the vacuum cleaner head. The body dusts and cleans the mop boards and floor moldings as it is moved therealong at the same time the floor adjacent the mop boards is vacuumed. The body is not a rigid, but tends toward a generally linear extended configuration and is releasably fastened to front and side portions of a vacuum cleaner head with cooperating strips of hook and loop fastener.

A protruding lip extends elongately between opposing end portions of the body, and bending the body around the periphery of the vacuum cleaner head, in order to attach the body thereto, causes the lip to protrude forwardly and outwardly away from the body. The forward and outward protrusion allows the lip to frictionally communicate with the horizontal surfaces and concave depressions of the mop board, as the vacuum carrying the body is operated adjacent the mop board. Friction between the heavy pile fleece and the mop board as the body is moved thereagainst and therealong generates a charge of static electricity in the fleece. The static electricity enhances the dust gathering tendency of the fleece. The body is also machine washable.

My invention does not reside in any one of the identified features individually but rather in the synergistic combination of all of its structures, which give rise to the functions necessarily flowing therefrom as hereinafter specified and claimed.

SUMMARY

My bumper and dusting attachment for a vacuum cleaner head generally provides a flexible elongate body having a first end portion, a second end portion, a top edge, a bottom edge, a back surface and a front surface and defines an elongate medial chamber therebetween. The body is formed of material having heavy pile fleece on a first exterior side. The fleece is a soft woolly covering and may be natural or synthetic. Padding, having a retentive memory, is carried in the medial chamber. A protruding lip formed in the front surface extends elongately from the first end portion to the second end portion and protrudes forwardly and outwardly from the front surface when the body is fastened to a vacuum cleaner head. Cooperating strips of hook and loop fastener carried by the back surface of the body and the vacuum cleaner head provide for releasable attachment of the body to a periphery of the vacuum cleaner head.

In providing such an apparatus it is:

A principal object to provide a bumper and dusting attachment for a vacuum cleaner head that simultaneously dusts mop boards and floor moldings while protecting the mop boards, floor moldings and furniture from damage caused by the vacuum cleaner head.

A further object is to provide such a bumper and dusting attachment for a vacuum cleaner head that uses frictionally created static electricity in the fleece to enhance dust gathering and cleaning effectiveness.

A further object is to provide such a bumper and dusting attachment for a vacuum cleaner head that is machine washable.

A further object is to provide such a bumper and dusting attachment for a vacuum cleaner head that is unitary and has no detachable parts that may be lost or misplaced.

A further object is to provide such a bumper and dusting attachment for a vacuum cleaner head having a lip that protrudes forwardly and outwardly from the body when the body is fastened to a vacuum cleaner head.

A still further object is to provide such a bumper and dusting attachment for a vacuum cleaner head that dusts and cleans horizontal, concave and vertical surfaces of mop boards and floor moldings as the vacuum is moved thereagainst and therealong.

A still further object is to provide such a bumper and dusting attachment for a vacuum cleaner head that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

DESCRIPTION OF PREFERRED EMBODIMENT

Figure 1:
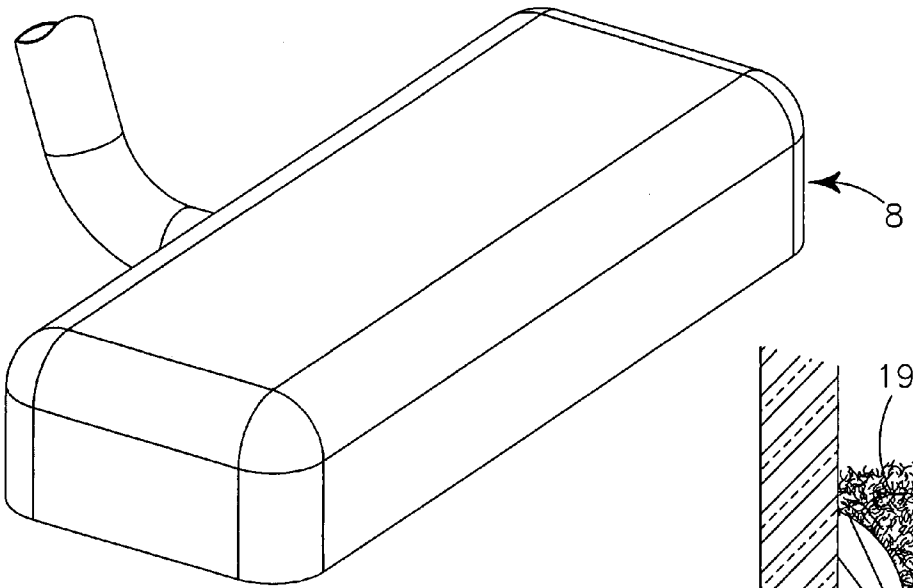
FIG. 1 Prior Art
FIG. 1 is an isometric top, front and right side view of a vacuum cleaner head of the type to which the instant invention would be fastened.
Figure 4:
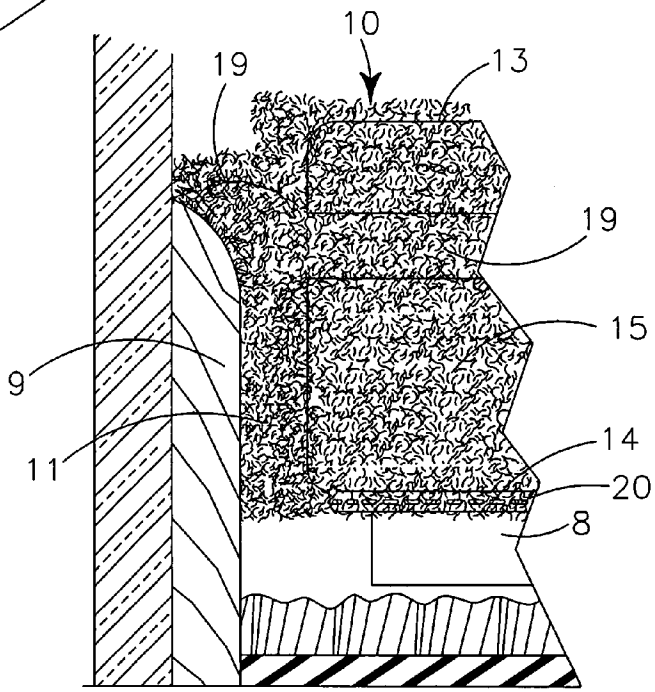
FIG. 4 is a floor level orthographic partial cut away front view of the instant invention installed on a vacuum cleaner head during use showing the front surface, the second end portion and the protruding lip dusting an adjacent mop board.
Figure 3:
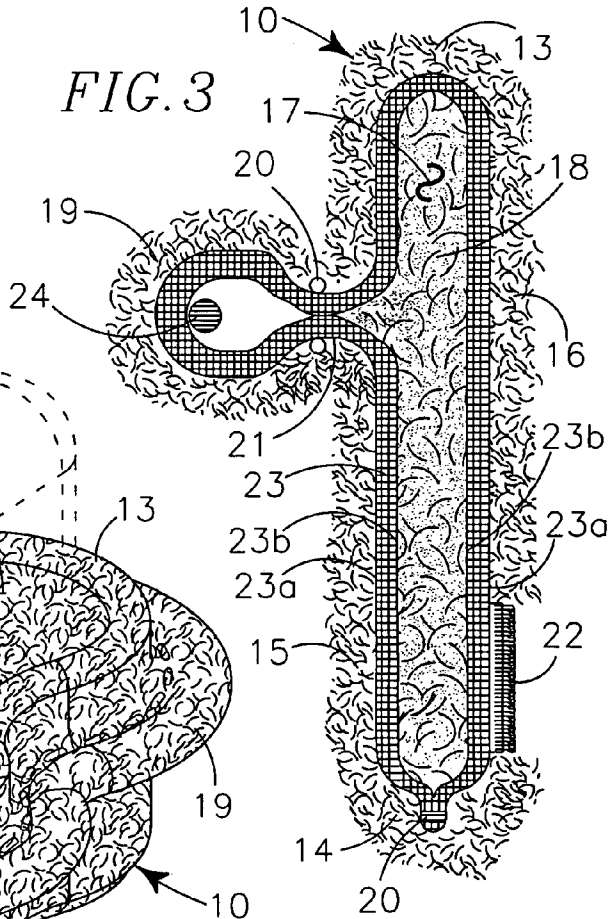
FIG. 3 is an enlarged vertical cross sectional view of the instant invention showing the top and bottom edges, the padding between the front and back surfaces and the outwardly protruding lip taken on the Line 3-3 on FIG. 2 in the direction indicated by the arrows.
Figure 2:
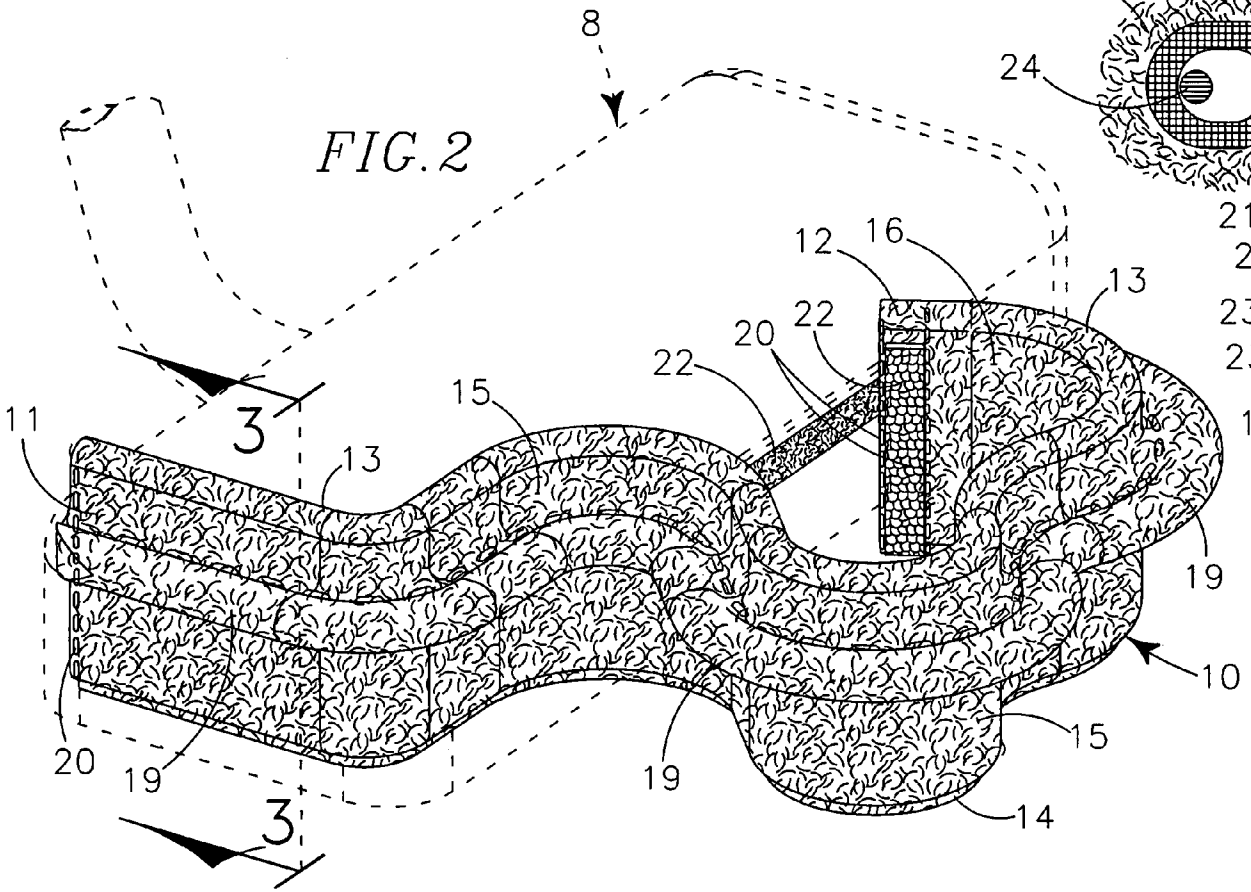
FIG. 2 is an isometric top, front and right side view of a vacuum cleaner head with the instant invention partially attached thereto showing the first and second end portions, the front and back surfaces and strips of the hook and loop fastener.

As used herein, the term "bottom", its derivatives, and grammatical equivalents refers to the portion of my bumper and dusting attachment for a vacuum cleaner head that is closest to a supporting surface such as a floor. The term "top", its derivatives, and grammatical equivalents refers to the portion of my bumper and dusting attachment for a vacuum cleaner head that is most distant from the supporting surface. The term "rearward", its derivatives, and grammatical equivalents refers to the portion of my bumper and dusting attachment for a vacuum cleaner head that is closest to the carrying vacuum cleaner head. The term "forward", its derivatives, and grammatical equivalents refers to the portion of my bumper and dusting attachment for a vacuum cleaner head that is most distant from the carrying vacuum cleaner head.

My bumper and dusting attachment for a vacuum cleaner head generally provides a flexible elongate body 10 having a first end portion 11, a second end portion 12, a top edge 13, a bottom edge 14, a back surface 16 and a front surface 15 and defines an elongate medial chamber 17 therebetween. The body 10 is formed of mesh type material 23 having heavy pile fleece on a first exterior side 23*a* and without fleece at a second interior side 23*b*. The fleece is a soft woolly covering and may be natural or synthetic.

The first end portion 11, the second end portion 12 and the bottom edge 14 of the body 10 are closed with stitching 20. The medial chamber 17 is filled with padding 18 having some retentive memory that provides thickness to the body 10 and spaces the front surface 15 away from the back surface 16.

A protruding lip 19 carried by the front surface 15 extends elongately from the first end portion 11 to the second end portion 12 and extends forwardly and outwardly from the front surface 15 when the body 10 is fastened to a periphery of a vacuum cleaner head 8. The lip 19 is formed in the front surface 15 prior to closing the first and second end portions 11, 12 and bottom edge 14 with stitching 20, by folding the front surface 15 of the body 10 over upon itself at a crease 21 and fastening the folded over portion together with stitching at the crease 21. Upholstery cord 24 may be enclosed within the lip 19 to add rigidity.

Strips of hook and loop fastener 22 are attached, with stitching 20, to the back surface 16 of the body 10 at the first and second end portions 11, 12 respectively, and along the bottom edge 14. Cooperating strips of hook and loop fastener 22 are attached to the front and side portions of the periphery of the vacuum cleaner head 8, preferably with adhesive, to provide a releasable attaching means for fastening the body 10 to the vacuum cleaner head 8.

Having described the structure of my bumper and dusting attachment for a vacuum cleaner head, its operation may be understood.

To install the body 10, the strip of hook and loop fastener 22 along the bottom edge 14 of the back surface 16 of the body 10 is engaged with the cooperating strip of hook and loop fastener 22 on the front periphery of the vacuum cleaner head 8. The strips of hook and loop fastener 22 at the first end portion 11 and the second end portion 12 of the body 10 are engaged with the cooperating strips of hook and loop fastener 22 on the sides of the vacuum cleaner head 8 so that the first and second end portions 11, 12 wrap, at least partially, around the sides of the vacuum cleaner head 8. Attaching the body 10 to the vacuum cleaner head 8 causes the lip 19 to protrude forwardly from the front surface 15 and to extend laterally outwardly from the first end portion 11 and second end portion 12 at the side portions of the vacuum cleaner head 8.

The vacuum is operated as is customary. Frictional engagement between the body 10 and the lip 19 and the mop boards 9 as the vacuum is operated thereagainst and therealong generates friction which responsively generates a charge of static electricity in the fleece. The static electricity enhances the dust and dirt gathering tendency of the fleece.

To remove the body 10 from the vacuum cleaner head 8, the above described steps are generally reversed. The body 10 may be cleaned to remove accumulated dust and dirt by washing and drying as desired.

The foregoing description of my invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

Having thusly described my invention, what I desire to protect by Letters Patent, and

What I claim is:

1. A bumper and dusting attachment, for a vacuum cleaner head having a periphery with a front and opposing first and second sides, to protect and dust mop boards, floor moldings and furniture while vacuuming, the bumper and dusting attachment comprising in combination:

a flexible body having a first end portion, an opposing second end portion, a top edge, a bottom edge, a front surface and a back surface, the body having a length sufficient to extend simultaneously about the front and at least a portion of first and second sides of the vacuum cleaner head;

a medial chamber defined by the body containing resiliently deformable padding;

a protruding lip carried on the front surface extending from the first end portion to the second end portion spacedly below the top edge that extends outwardly from the body when the body is fastened to the vacuum cleaner head; and means to releasably fasten the body to the periphery of the vacuum cleaner head.

2. The bumper and dusting attachment for a vacuum cleaner head of claim 1 wherein:

the front surface of the body and the protruding lip are covered with fleece.

3. The bumper and dusting attachment for a vacuum cleaner head of claim 1 wherein:

the body gathers a charge of static electricity due to friction of the body against mop boards and floor moldings during the use; and the static electricity enhances collection of dust and debris from the mop boards, floor of moldings and surfaces being dusted.

4. The bumper and dusting attachment for a vacuum cleaner head of claim 1 wherein:

the body is machine washable.

5. The bumper and dusting attachment for a vacuum cleaner head of claim 1 wherein:

the protruding lip is formed into the front surface by folding the front surface over upon itself and securing the folded over portion in place with stitching.

6. The bumper and dusting attachment for a vacuum cleaner head of claim 1 wherein:

fastening the body to the periphery of the vacuum cleaner head with the releasable fastening means causes the protruding lip to protrude forwardly from the front surface of the body and protrude laterally outwardly from the first end portion and second end portion at the opposing sides of the periphery of the vacuum cleaner head.

7. The bumper and dusting attachment for a vacuum cleaner head of claim 1 wherein:

the means to releasably fasten the body to the periphery of the vacuum cleaner head is hook and loop fastener carried by the back surface of the body and by the periphery of the vacuum cleaner head.

8. A bumper and dusting attachment, for a vacuum cleaner head having a periphery with a front and opposing first and second sides, to protect and dust mop boards, floor moldings and furniture while vacuuming, the bumper and dusting attachment comprising in combination:

a flexible machine washable body, the body having a first end portion, an opposing second end portion, a top edge, a bottom edge, a front surface, a back surface, and a length sufficient to extend simultaneously about the front and at least a portion of the first and second opposing sides of the vacuum cleaner head, and fleece covering the front surface;

a medial chamber between the front surface and the back surface, between the top edge and bottom edge and between the first end portion and the second end portion containing resiliently deformable padding to space the front surface away from the back surface;

a protruding lip carried by the front surface extending elongately from the first end portion to the second end portion spacedly below the top edge and protruding forwardly from the front surface of the body and protruding laterally outwardly from the first end portion and second end portion when the body is fastened to the periphery of the vacuum cleaner head; and hook and loop releasable fastening means carried by the back surface of the body and the periphery of the vacuum cleaner head to releasably fasten the body to the periphery of the vacuum cleaner head.

* * * * *